US008231433B2

(12) United States Patent
Haneda et al.

(10) Patent No.: US 8,231,433 B2
(45) Date of Patent: Jul. 31, 2012

(54) POLISHING METHOD AND POLISHING APPARATUS

(75) Inventors: Kazuyuki Haneda, Ichihara (JP); Satoshi Fujinami, Minamitsuru-gun (JP)

(73) Assignee: Showa Denko K.K., Tokyo (JP)

( * ) Notice: Subject to any disclaimer, the term of this patent is extended or adjusted under 35 U.S.C. 154(b) by 1118 days.

(21) Appl. No.: 12/033,263

(22) Filed: Feb. 19, 2008

(65) Prior Publication Data

US 2008/0200097 A1 Aug. 21, 2008

(30) Foreign Application Priority Data

Feb. 20, 2007 (JP) ..... 2007-039241

(51) Int. Cl.
*B24B 9/06* (2006.01)

(52) U.S. Cl. ..... 451/44; 451/59; 451/63

(58) Field of Classification Search ..... 451/57, 451/59, 63, 44, 41, 28
See application file for complete search history.

(56) References Cited

U.S. PATENT DOCUMENTS

| | | | | |
|---|---|---|---|---|
| 6,280,294 | B1 * | 8/2001 | Miyamoto | 451/34 |
| 6,615,613 | B1 * | 9/2003 | Iwabuchi et al. | 65/61 |
| 7,959,492 | B2 | 6/2011 | Haneda et al. | |
| 2002/0115391 | A1 | 8/2002 | Yamaguchi et al. | |
| 2003/0082999 | A1 | 5/2003 | Yoshikawa et al. | |
| 2005/0101230 | A1 | 5/2005 | Yoshikawa et al. | |
| 2007/0196699 | A1 | 8/2007 | Aida et al. | |
| 2007/0249267 | A1 | 10/2007 | Aida et al. | |

FOREIGN PATENT DOCUMENTS

| | | | |
|---|---|---|---|
| JP | 10-154321 | A | 6/1998 |
| JP | 11-028649 | A | 2/1999 |
| JP | 2000-024906 | A | 1/2000 |
| JP | 2000-357351 | A | 12/2000 |
| JP | 2001-332517 | A | 11/2001 |
| JP | 2002-123931 | A | 4/2002 |
| JP | 2003-159639 | A | 6/2003 |
| JP | 2005-022047 | A | 1/2005 |
| JP | 2006-015450 | A | 1/2006 |
| JP | 2006-079800 | A | 3/2006 |
| JP | 2006-088322 | A | 4/2006 |
| JP | 2006-236561 | A | 9/2006 |

* cited by examiner

*Primary Examiner* — Robert Rose
(74) *Attorney, Agent, or Firm* — Sughrue Mion, PLLC

(57) ABSTRACT

The polishing method of a disk-shaped substrate for polishing an outer circumference 13 of a disk-shaped substrate using slurry is provided with in this sequence: a first polishing process for polishing the outer circumference 13 using an abrasive-grain inclusion brush 50 made of a resin in which polishing abrasive grains are included; and a second polishing process for polishing the outer circumference 13 using a resin brush 60 made of a resin in which the polishing abrasive grains are not included.

7 Claims, 7 Drawing Sheets

FIG.1A FIRST LAPPING PROCESS
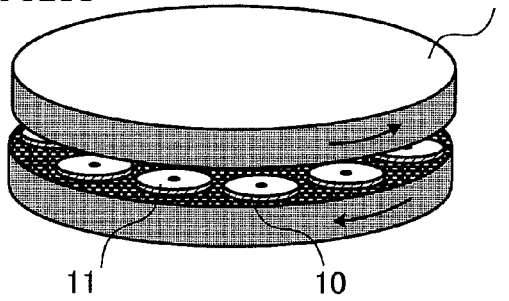
FIG.1B INNER AND OUTER CIRCUMFERENCE GRINDING PROCESS
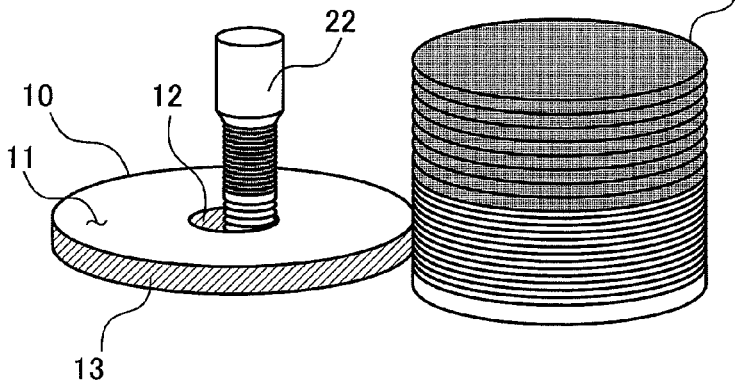
FIG.1C OUTER CIRCUMFERENCE POLISHING PROCESS
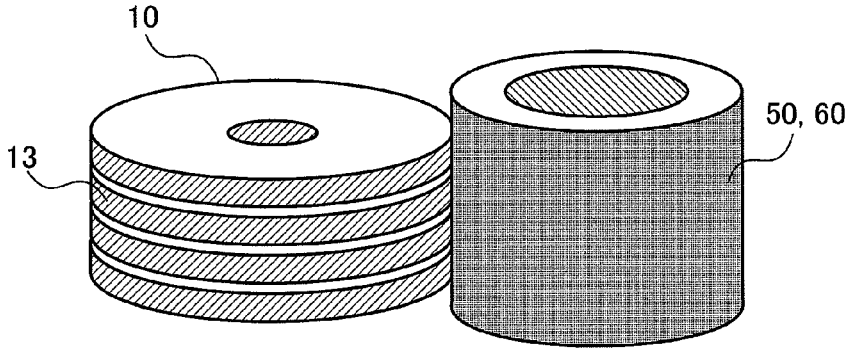
FIG.1D SECOND LAPPING PROCESS
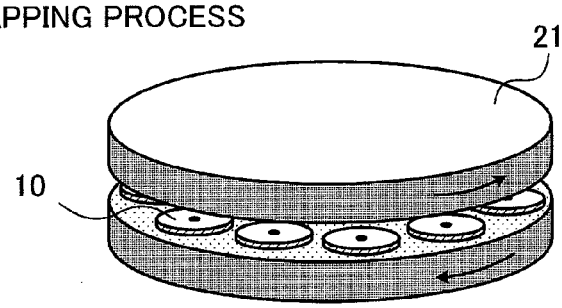

FIG.1E INNER CIRCUMFERENCE POLISHING PROCESS
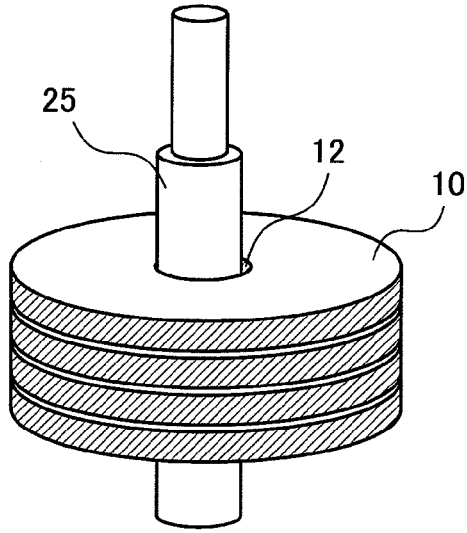
FIG.1F FIRST POLISHING PROCESS
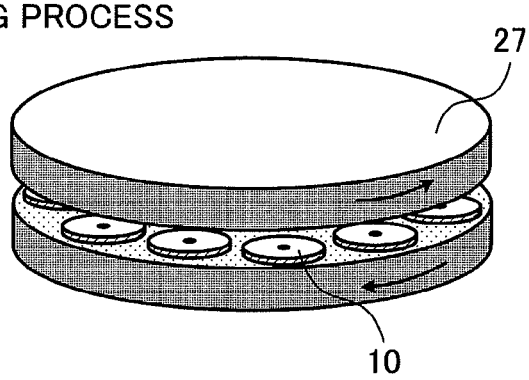
FIG.1G SECOND POLISHING PROCESS
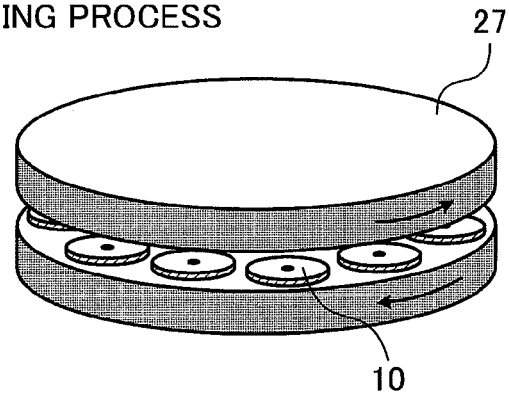
FIG.1H FINAL WASHING AND INSPECTION PROCESS
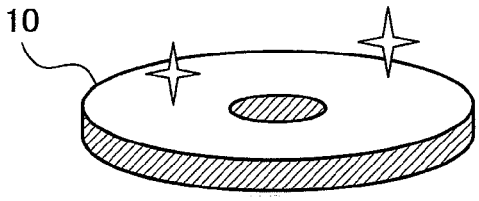

POLISHING METHOD AND POLISHING APPARATUS

CROSS REFERENCE TO RELATED APPLICATIONS

This application is based on and claims priority under 35 USC §119 from Japanese Patent Application No. 2007-39241 filed Feb. 20, 2007.

BACKGROUND OF THE INVENTION

1. Field of the Invention

The present invention relates to a polishing method of a disk-shaped substrate such as a glass substrate for a magnetic recoding medium, a polishing apparatus and the like.

2. Description of the Related Art

In recent years, the production of disk substrates as disk-shaped substrates has been activated, under increased demands as recording media. As a magnetic disk substrate that is one of the disk substrates, an aluminum substrate and a glass substrate are used widely. The aluminum substrate is characterized by its high processability and low cost, meanwhile the glass substrate is characterized by its excellent strength, surface smoothness and flatness. In particular, requirements for compact size and high density of disk substrates recently have become extremely high, and the glass substrate of which surface roughness is small and that enables high density has attracted a lot of attention.

Various improvements have been made for manufacturing method of such the magnetic disk-shaped substrate. For example, there is a related art in which an edge face of the glass substrate is polished by brush polishing in order to address a problem that a projection portion is formed on the magnetic disk surface by particles on the glass substrate, and the projection portion becomes thermal asperity and fluctuates a resistance value of a magnetoresistive head (See Patent Document 1, for example). In Patent Document 1, by brush polishing using slurry, edge face portions of the glass substrate (angular portions, side surfaces and chamfered portions) are polished while the glass substrate is rotated so that the angular portion is made into a curved surface and surface roughness falls within a predetermined range.

Also, as another Patent Document, with the purpose of efficient outer circumferential surface work of a glass disk, lowered facility costs and improved yield, there is a related art in which a polishing brush rotating with respect to piled glass disks is reciprocated and oscillated vertically (See Patent Document 2, for example). In this Patent Document 2, work efficiency is further improved by polishing plural sets of piled glass disks with plural polishing brushes.

[Patent Document 1]

Japanese Unexamined Patent Application Publication No. 10-154321.

[Patent Document 2]

Japanese Unexamined Patent Application Publication No. 11-28649.

Here, polishing using a brush is carried out in a process after grinding processing in general. Therefore, numerous grinding marks are present on the edge face of the glass substrate, and the circumference of the numerous grinding marks is preferably polished to smooth the surface. At this time, if a brush with a bristle made of polyamide resin and the like is used for polishing, polishing ability of the brush is low and deep grinding marks may not be smoothed only by the polishing ability of slurry. Particularly, in order to make an angular portion on the edge face into a curved surface, a diameter of the brush tip end is required to be reduced so that the brush enters the chamfered portion, but when a thin brush bristle is used in order to reduce the diameter of the brush tip end, the brush will lose stiffness and the polishing ability will be lowered.

The present invention is made in order to address the above problems and has an object to improve polishing performance in a polishing process by a brush and to smooth marks such as grinding marks.

SUMMARY OF THE INVENTION

According to an aspect of the invention, there is provided a polishing method of a disk-shaped substrate for polishing an edge face of a disk-shaped substrate using polishing liquid, including in this sequence: a first polishing process for polishing the edge face using a first brush made of a resin in which polishing abrasive grains are included; and a second polishing process for polishing the edge face using a second brush made of a resin in which the polishing abrasive grains are not included.

In one aspect of the polishing method of a disk-shaped substrate of the present invention, the polishing abrasive grains are formed from aluminum oxide or diamond.

In another aspect of the polishing method of a disk-shaped substrate of the present invention, the resin as a material of the first brush is polyamide resin or polyester resin.

In further aspect of the polishing method of a disk-shaped substrate of the present invention, in the first polishing process and the second polishing process, the disk-shaped substrates are piled so that the outer circumferential edge faces of the piled disk-shaped substrates are opposed to the first or second brush, and a side wall portion and a chamfered portion provided on the outer circumferential edge face are polished at the same time.

In furthermore aspect of the polishing method of a disk-shaped substrate of the present invention, the disk-shaped substrates are piled with a spacer interposed between the disk-shaped substrates adjacent to each other, the spacer having an outer diameter smaller than a diameter of the disk-shaped substrate.

In furthermore aspect of the polishing method of a disk-shaped substrate of the present invention, in the first polishing process, the piled disk-shaped substrates are opposed to the first brush and polished, and the piled disk-shaped substrates are inverted, opposed to the first brush and polished.

In furthermore aspect of the polishing method of a disk-shaped substrate of the present invention, in the second polishing process, the piled disk-shaped substrates are opposed to the second brush and polished, and the piled disk-shaped substrates are inverted, opposed to the second brush and polished.

In furthermore aspect of the polishing method of a disk-shaped substrate of the present invention, in the first polishing process, a plurality of the first brushes are provided, a plurality of the piled disk-shaped substrates are set at different positions, each of the plurality of piled disk-shaped substrates is polished while being in contact with the plurality of first brushes, and then, each of the plurality of piled disk-shaped substrates is moved to one of the positions of other piled disk-shaped substrates and polished while being in contact with the plurality of first brushes.

In furthermore aspect of the polishing method of a disk-shaped substrate of the present invention, in the second polishing process, a plurality of the second brushes are provided, a plurality of the piled disk-shaped substrates are set at different positions, each of the plurality of piled disk-shaped substrates is polished while being in contact with the plurality of second brushes, and then, each of the plurality of piled disk-shaped substrates is moved to one of the positions of other piled disk-shaped substrates and polished while being in contact with the plurality of second brushes.

According to another aspect of the invention, there is provided a polishing apparatus that polishes an outer circumferential edge face of a disk-shaped substrate using polishing liquid, the polishing apparatus including: a mounting unit that mounts the disk-shaped substrates piled with a spacer interposed; and a polishing unit that comprises a brush made of a resin including polishing abrasive grains and that polishes a side wall portion and a chamfered portion at the same time by bringing the brush into contact with the side wall portion and the chamfered portion on the outer circumferential edge face of the disk-shaped substrate mounted on the mounting unit.

In one aspect of the polishing apparatus of the present invention, the polishing unit is provided with: a first rotating mechanism that rotates the disk-shaped substrate in a first direction; a second rotating mechanism that rotates the brush in a second direction opposite to the first direction; and a moving mechanism that reciprocates the disk-shaped substrate and the brush relatively in an axial direction.

In another aspect of the polishing apparatus of the present invention, the brush is made of polyamide resin or polyester resin, and the polishing abrasive grains that are formed from aluminum oxide or diamond.

BRIEF DESCRIPTION OF THE DRAWINGS

Exemplary embodiment(s) of the present invention will be described in detail based on the following figures, wherein:

FIG. 1A to FIG. 1H are diagrams illustrating the manufacturing process of a disk-shaped substrate (a disk substrate) to which the exemplary embodiments of the present invention are applied;

DETAILED DESCRIPTION OF THE EMBODIMENTS

Figure 2:
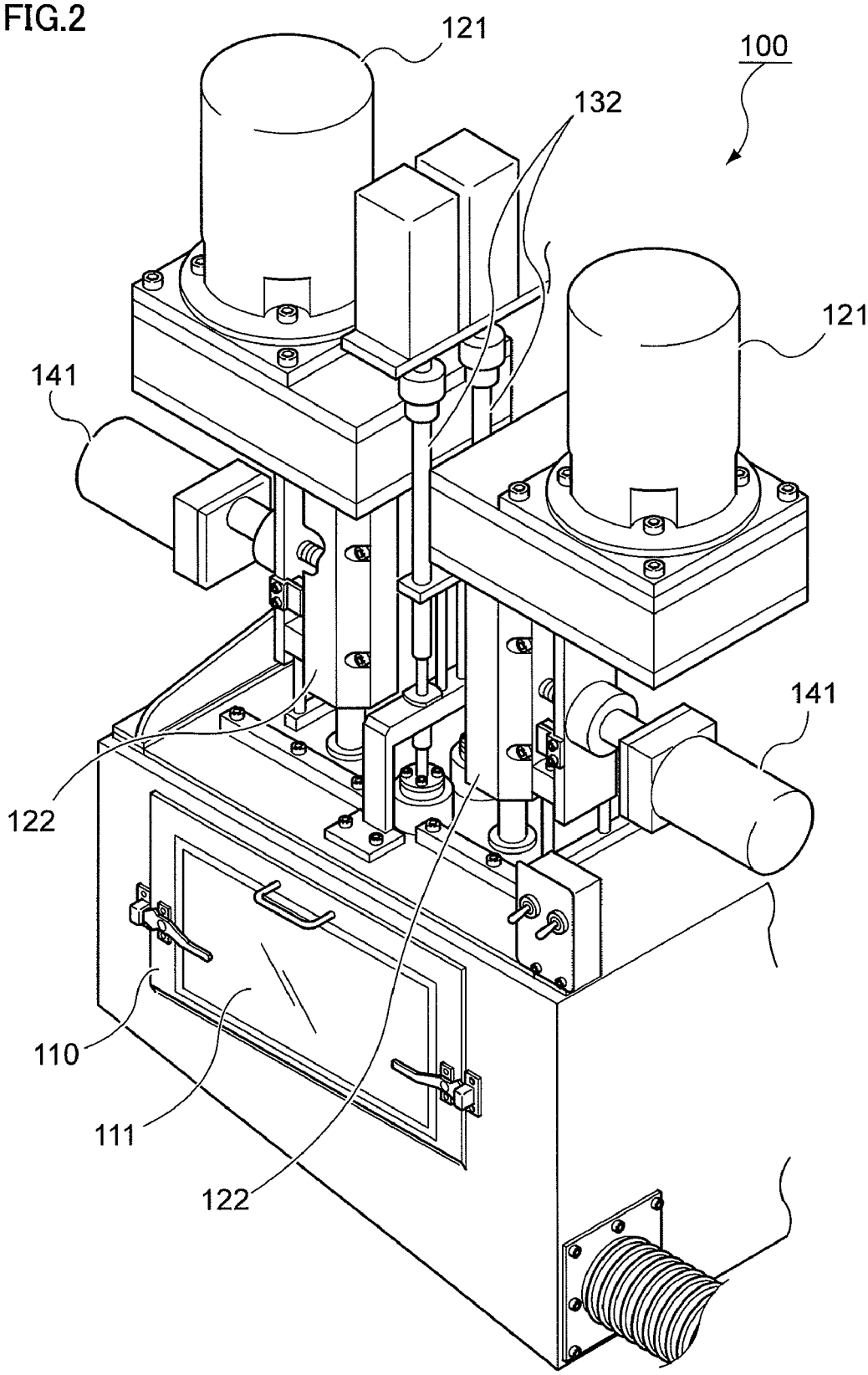
FIG. 2 is a view illustrating an outline configuration of the polishing apparatus.

Hereinafter, exemplary embodiments of the present invention will be described in detail with reference to the attached drawings.

FIG. 1A to FIG. 1H are diagrams illustrating the manufacturing process of a disk-shaped substrate (a disk substrate) to which the exemplary embodiments of the present invention are applied. In this manufacturing process, first, in a first lapping process shown in FIG. 1A, raw materials of disk-shaped substrates 10 (workpieces) are put on a fixed base 21, and flat surfaces 11 of the disk-shaped substrates 10 are ground. At this moment, on the surface of the fixed base 21 on which the disk-shaped substrates 10 are put, for example, abrasives of diamond are dispersed and spread.

Next, in an inner and outer circumference grinding process shown in FIG. 1B, an inner circumference 12 of a portion having a hole formed at the center of the disk-shaped substrate 10 is ground by an inner circumference grind stone 22, and an outer circumference 13 of the disk-shaped substrate 10 is ground by an outer circumference grind stone 23. At this moment, the surface of the inner circumference 12 (an inner circumferential edge face) and the surface of the outer circumference 13 (an outer circumferential edge face) of the disk-shaped substrate 10 are held in the radial direction of the disk-shaped substrate 10 and processed at the same time by the inner circumference grind stone 22 and the outer circumference grind stone 23, and thereby coaxial degrees of the inner diameter and the outer diameter are easily secured. On the surfaces of the inner circumference grind stone 22 and the outer circumference grind stone 23, for example, abrasives of diamond are dispersed and spread.

In an outer circumference polishing process shown in FIG. 1C, first, the outer circumferences 13 of the disk-shaped substrates 10 ground in the inner and outer circumference grinding process shown in FIG. 1B are brush-polished using an abrasive-grain inclusion brush 50 which is a brush for polishing an outer circumference while supplying slurry (polishing liquid), and then, brush polishing is carried out using a resin brush 60 while supplying slurry.

Thereafter, in a second lapping process shown in FIG. 1D, the disk-shaped substrates 10 are mounted on the fixed base 21, and the flat surfaces 11 of the disk-shaped substrates 10 are further ground.

Next, in an inner circumference polishing process shown in FIG. 1E, an inner circumference polishing brush 25 is inserted into the portions having the hole at the center of the disk-shaped substrates 10, and the inner circumference 12 of the disk-shaped substrates 10 is polished. Thereafter, in a first polishing process shown in FIG. 1F, the disk-shaped substrates 10 are mounted on a fixed base 27, and the flat surfaces 11 of the disk-shaped substrates 10 are polished. In the polishing process at this moment, for example, hard polisher is used as non-woven cloth (polishing cloth). Further, in a second polishing process shown in FIG. 1G, the flat surfaces 11 are polished by use of soft polisher. Thereafter, in a final washing and inspection process shown in FIG. 1H, washing and inspection are carried out, and thereby the disk-shaped substrates 10 as a disk substrate are manufactured.

Here, the outer circumference polishing process shown in FIG. 1C, which is a characteristic process of the present exemplary embodiment will be detailed.

Figure 3:
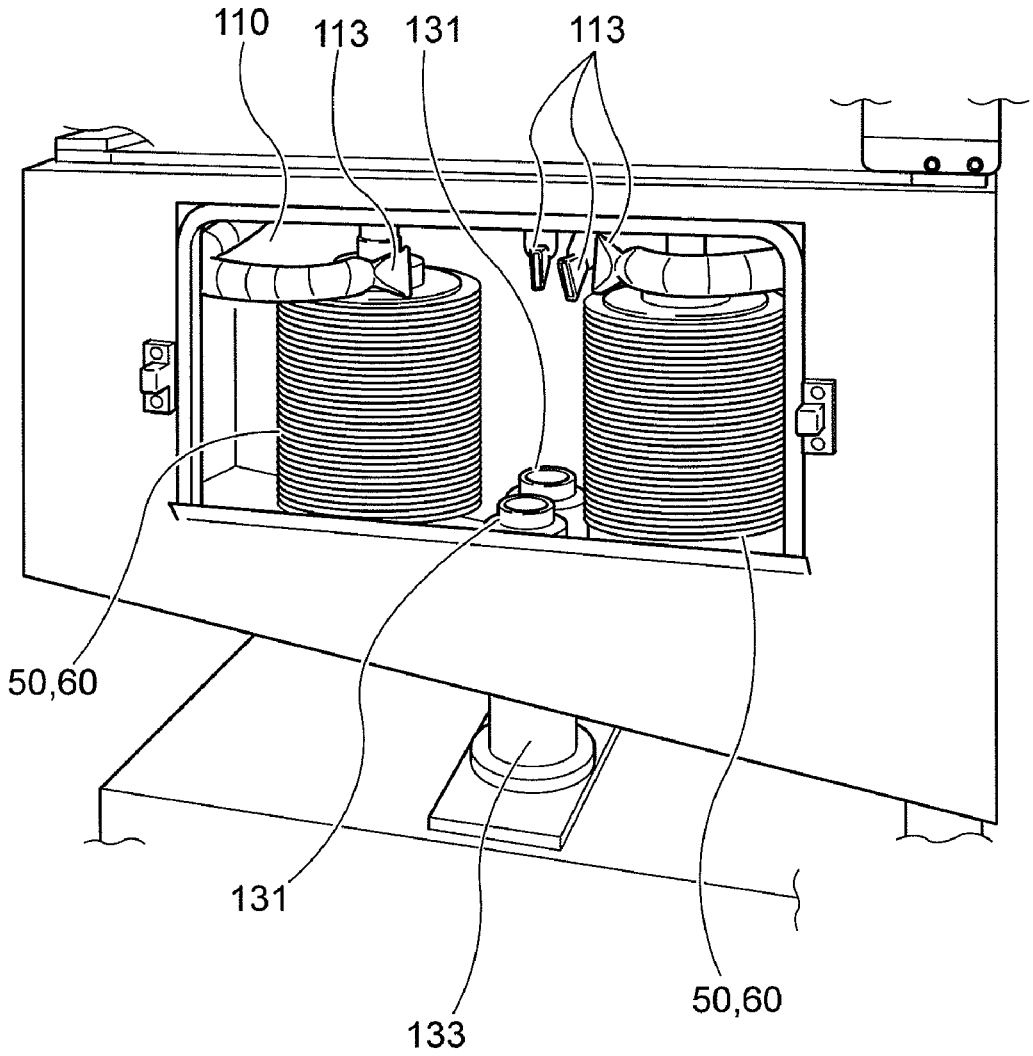
FIG. 3 is a view for explaining a state of brushes (the abrasive-grain inclusion brushes or the resin brushes) provided in the polishing apparatus.
Figure 4:
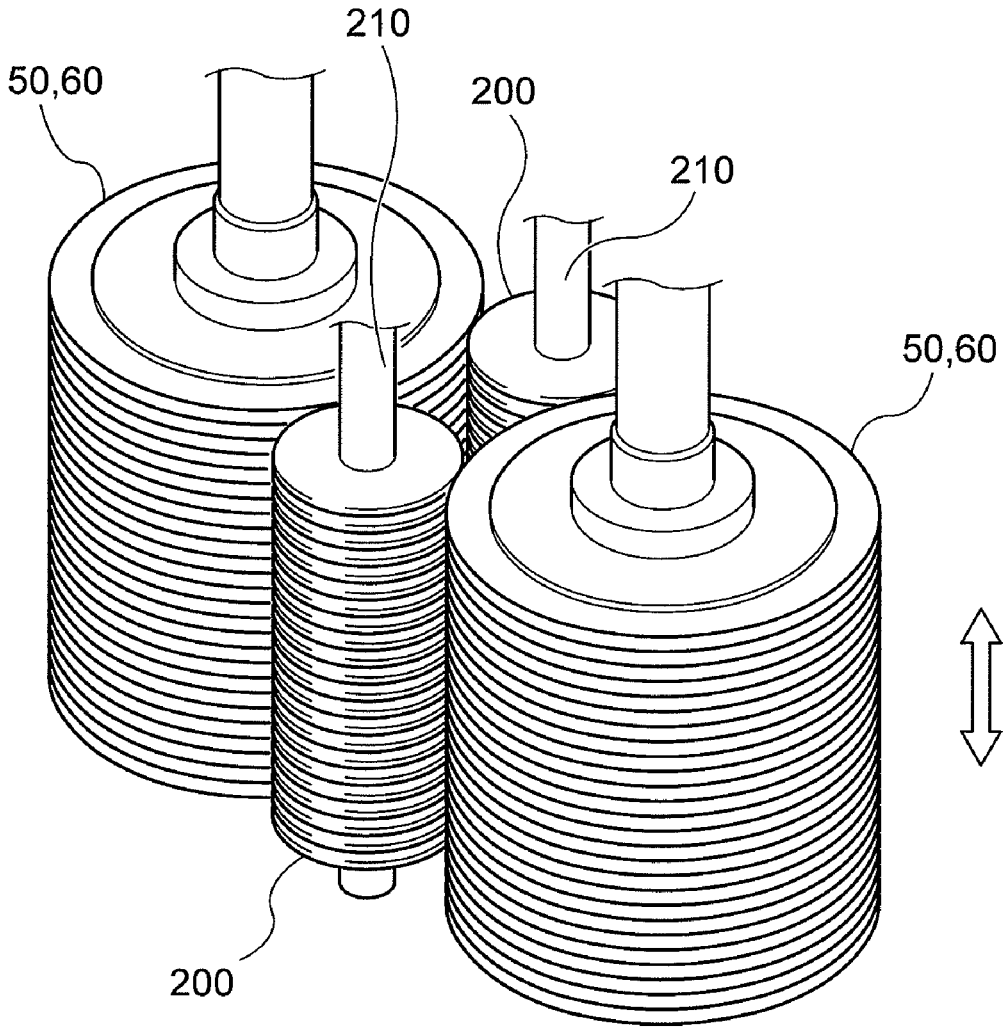
FIG. 4 is a view for explaining a mounting state of the brushes (the abrasive-grain inclusion brushes or the resin brushes) and piled workpieces in which the disk-shaped substrates are piled in the polishing apparatus.

FIGS. 2 to 4 show a configuration of a polishing apparatus 100 used in executing the outer circumference polishing process. FIG. 2 is a view illustrating an outline configuration of the polishing apparatus 100, and FIG. 3 is a view for explaining a state of brushes (the abrasive-grain inclusion brushes 50 or the resin brushes 60) provided in the polishing apparatus 100. FIG. 4 is a view for explaining a mounting state of the brushes (the abrasive-grain inclusion brushes 50 or the resin brushes 60) and piled workpieces 200 in which the disk-shaped substrates 10 are piled in the polishing apparatus 100.

In the present exemplary embodiment, the outer circumference polishing process comprises two processes: a first polishing process using the abrasive-grain inclusion brushes 50 and a second polishing process using the resin brushes 60. In the first polishing process and the second polishing process, the polishing apparatus 100 explained in FIGS. 2 to 4 is used, respectively, to carry out polishing work while supplying the slurry (the polishing liquid).

The polishing apparatus 100 shown in FIG. 2 is provided with a polishing work area 110 for carrying out the polishing work and a window 111 that is opened when the piled workpieces 200 are mounted to the polishing work area 110. As a rotation and slide mechanism of the brushes (the abrasive-grain inclusion brushes 50 or the resin brushes 60), driving motors 121 for rotating the brushes (the abrasive-grain inclusion brushes 50 or the resin brushes 60) and slide mechanisms 122 for reciprocating the brushes (the abrasive-grain inclusion brushes 50 or the resin brushes 60) in the axial direction are provided. The slide mechanism 122 functions as an example of a moving mechanism for relatively reciprocating and moving the disk-shaped substrates 10 (the piled workpieces 200) and the brushes, and is reciprocated in the brush axial direction by a motor (not shown in the figure) for slide and a link mechanism (not shown in the figure). The driving motor 121 functions as an example of a second rotating mechanism that rotates the brushes in a direction opposite to rotation of the disk-shaped substrates 10 (the piled workpieces 200).

In addition, the polishing apparatus 100 has plural support shafts 132 so as to be one end of rotation of each piled workpieces 200 after the plural sets of the piled workpieces 200 are mounted. In an example shown in FIG. 2, two support shafts 132 corresponding to two sets of the piled workpieces 200 are shown. Moreover, brush moving mechanisms 141 for pressing the brushes (the abrasive-grain inclusion brushes 50 or the resin brushes 60) to the plural sets of the piled workpieces 200 are provided. In the present exemplary embodiment, as shown in FIG. 4, the two brushes (the abrasive-grain inclusion brushes 50 or the resin brushes 60) are pressed to the two sets of the piled workpieces 200 from both sides (right and left sides) in the figure, and the brush moving mechanisms 141 that is shown in FIG. 2 are provided on both sides (right and left sides) in the figure.

Moreover, as shown in FIG. 3, the brushes (the abrasive-grain inclusion brushes 50 or the resin brushes 60) are arranged on both sides of the polishing work area 110, and two mounting portions 131 that may mount the two sets of the piled workpieces 200 are provided between the brushes (the abrasive-grain inclusion brushes 50 or the resin brushes 60). The mounting portion 131 functions as an example of a mounting unit that mounts the piled workpieces 200 piled with spacers 40 (which will be described later) interposed. In addition, plural nozzles 113 for supplying the slurry are provided in the polishing work area 110. Furthermore, on the lower side of the polishing work area 110, as an example of a first rotating mechanism, a driving shaft 133 that rotates and drives the piled workpieces 200 mounted on the mounting portions 131 in a direction opposite to the rotation direction of the brushes are provided.

Into the two sets of the piled workpieces 200 mounted on the mounting portions 131 in the polishing work area 110, shafts 210 are inserted respectively, and the two sets of the piled workpieces 200 are brought into contact with the two brushes (the abrasive-grain inclusion brushes 50 or the resin brushes 60) in such a state shown in FIG. 4. When the piled workpieces 200 are rotated by driving force of the driving shaft 133 and are polished by the two brushes (the abrasive-grain inclusion brushes 50 or the resin brushes 60) rotated by the driving motors 121 respectively. Each of the brushes (the abrasive-grain inclusion brushes 50 or the resin brushes 60) has plural bristles that are closely gathered each other on an annular core material or the like made of, for example, stainless steel so as to form bundles each of which are radially arranged.

Figure 5:
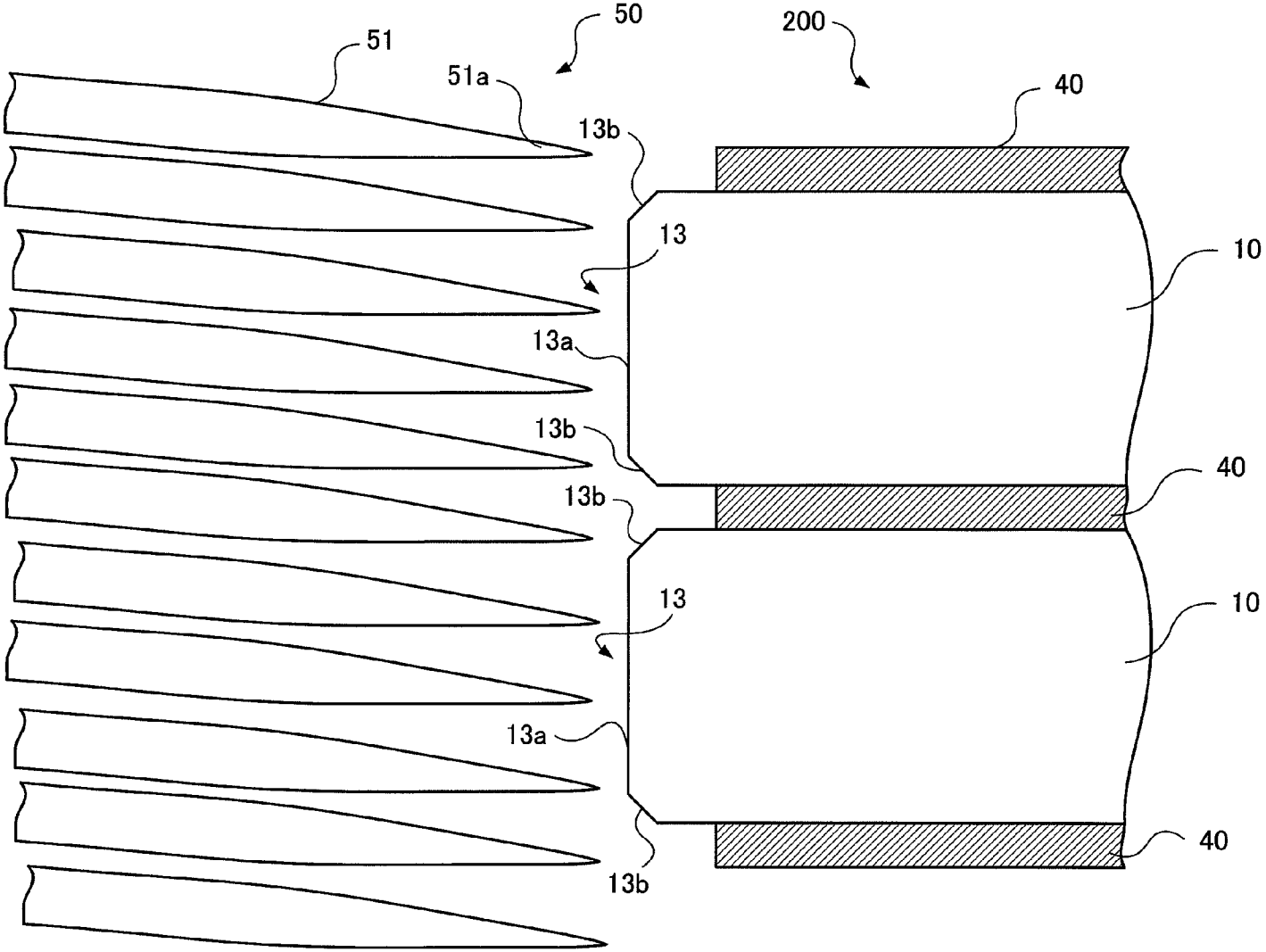
FIG. 5 is a diagram schematically showing polishing processing carried out using the abrasive-grain inclusion brushes in the first polishing process.

FIG. 5 is a diagram schematically showing polishing processing carried out using the abrasive-grain inclusion brushes 50 in the first polishing process. In FIG. 5, bristles 51 of the abrasive-grain inclusion brushes 50 and tip portions (bristle ends) 51*a* of the bristles 51 are shown. In the piled workpieces 200, the disk-shaped substrates 10 which are materials to be polished are piled with the spacers 40 interposed between them. A side wall portion 13*a* and chamfered portions 13*b* are on each of the outer circumferences 13 of the disk-shaped substrates 10. By piling the disk-shaped substrates 10 with the spacers 40 interposed between them, portions having a gap may be formed between the disk-shaped substrates 10 adjacent to each other in the state where the spacers 40 are interposed between them, and corner portions of the chamfered portions 13*b* may be made to be curved by polishing.

Here, as a material of the bristles 51 of the abrasive-grain inclusion brush 50 used in the present exemplary embodiment, for example, a polyamide resin, which is collectively called as nylon (registered trademark), including abrasive grains of aluminum oxide (alumina) is used. By using the bristles 51 made of the polyamide resin including alumina abrasive grains, the stiffness (elasticity or tenacity) of the bristles 51 is enhanced, and toughness and bending fatigue resistance may be improved. As a result, polishing ability is improved and favorable polishing is realized even if the relatively thin bristles 51 are used.

In order to polish the corner portions of the chamfered portions 13*b*, the tip portions (the bristle ends) 51*a* are preferably made to enter the portions having a gap that are formed by the spacers 40. In order to make the brush bristle ends enter the portions between the disk substrates 10 adjacent to each other, it is only necessary to employ thinner bristles in general. However, with a usual resin brush, if the bristles become thinner, the stiffness is weakened and the polishing ability is lowered. Consequently, by using the abrasive-grain inclusion brush 50 made of the polyamide resin including aluminum abrasive grains, a brush having high stiffness is obtained even if the bristles 51 are thin, the chamfered portions 13*b* of the disk-shaped substrates 10 may be polished favorably, and favorable polishing for making the corners curved may be realized.

Here, the spacers 40, in addition to the function to make the tip portions (the bristle ends) 51*a* enter the corner portions of the chamfered portions 13*b*, also has a function to block so that the tip portions (the bristle ends) 51*a* do not enter the inner side from the spacers 40. By the latter function, excessive polishing on the upper and lower flat surface portions of the disk-shaped substrates 10 may be prevented in advance.

The abrasive-grain inclusion brush 50 is worn more easily than the resin brush 60 not including abrasive grains, and a fact that the tip portions (the bristle ends) 51*a* of the bristles 51 tend to be thinned by use for a relatively short time is grasped by examination of the inventors or the like. In FIG. 5, a state where the tip portions (the bristle ends) 51*a* of the bristles 51 are thinned is shown. When the tip portions (the bristle ends) 51*a* of the bristles 51 are thinned, the tip portions (the bristle ends) 51*a* become easy to enter the portions having the gap formed by the spacers 40, which is a preferable state for polishing on the side wall portions 13*a* and the chamfered portions 13*b* of the outer circumferences 13. As mentioned above, by using the abrasive-grain inclusion brush 50 made of, for example, the polyamide resin including aluminum oxide (alumina) abrasive grains, high polishing ability provided by the abrasive-grain inclusion brush 50 having high stiffness and the entering effect by thinned tip portions (the bristle ends) 51*a*, damages which may not be fully eliminated by the usual resin brush 60 may be smoothed, and corners may be made to be curved. That is, in a polishing unit, by providing the abrasive-grain inclusion brush 50 that is made of resin including abrasive grains and that is brought into contact with the outer circumferences 13 (the outer circumferential edge face) of the disk-shaped substrates 10 and by bringing the abrasive-grain inclusion brush 50 into contact with the side wall portions 13*a* and the chamfered portions 13*b* on the outer circumferences 13 (the outer circumferential edge face) of the disk-shaped substrates 10 mounted on mounting units (the mounting portions 131 or the like), the side wall portions 13*a* and the chamfered portions 13*b* are polished at the same time.

As another aspect of the abrasive-grain inclusion brush 50, a brush made of a polyamide resin including abrasive grains of diamond or the like, or a brush made of a polyester resin such as PTB (polybutylene terephthalate) including abrasive grains of aluminum oxide, abrasive grains of diamond or the like may be used.

After the first polishing process using the abrasive-grain inclusion brushes 50, the process moves on to the second polishing process using the resin brushes 60 while supplying slurry by the polishing apparatus 100 using the resin brushes 60 as shown in FIGS. 2 to 4. Deep damages caused by, for example, grinding by grinding stones may be smoothed in the above-mentioned first polishing process, and after that, the surface is polished to a predetermined finishing accuracy in the second polishing process. The polishing apparatus 100 using the resin brushes 60 is preferably provided besides the polishing apparatus 100 using the abrasive-grain inclusion brushes 50 in terms of reduction of process time, but transition from the first polishing process to the second polishing process may be performed by changing the brushes in the same polishing apparatus 100 from the abrasive-grain inclusion brushes 50 to the resin brushes 60.

Next, a flow of outer circumference polishing processing executed using the above-mentioned polishing apparatus 100 will be described.

Figure 6:
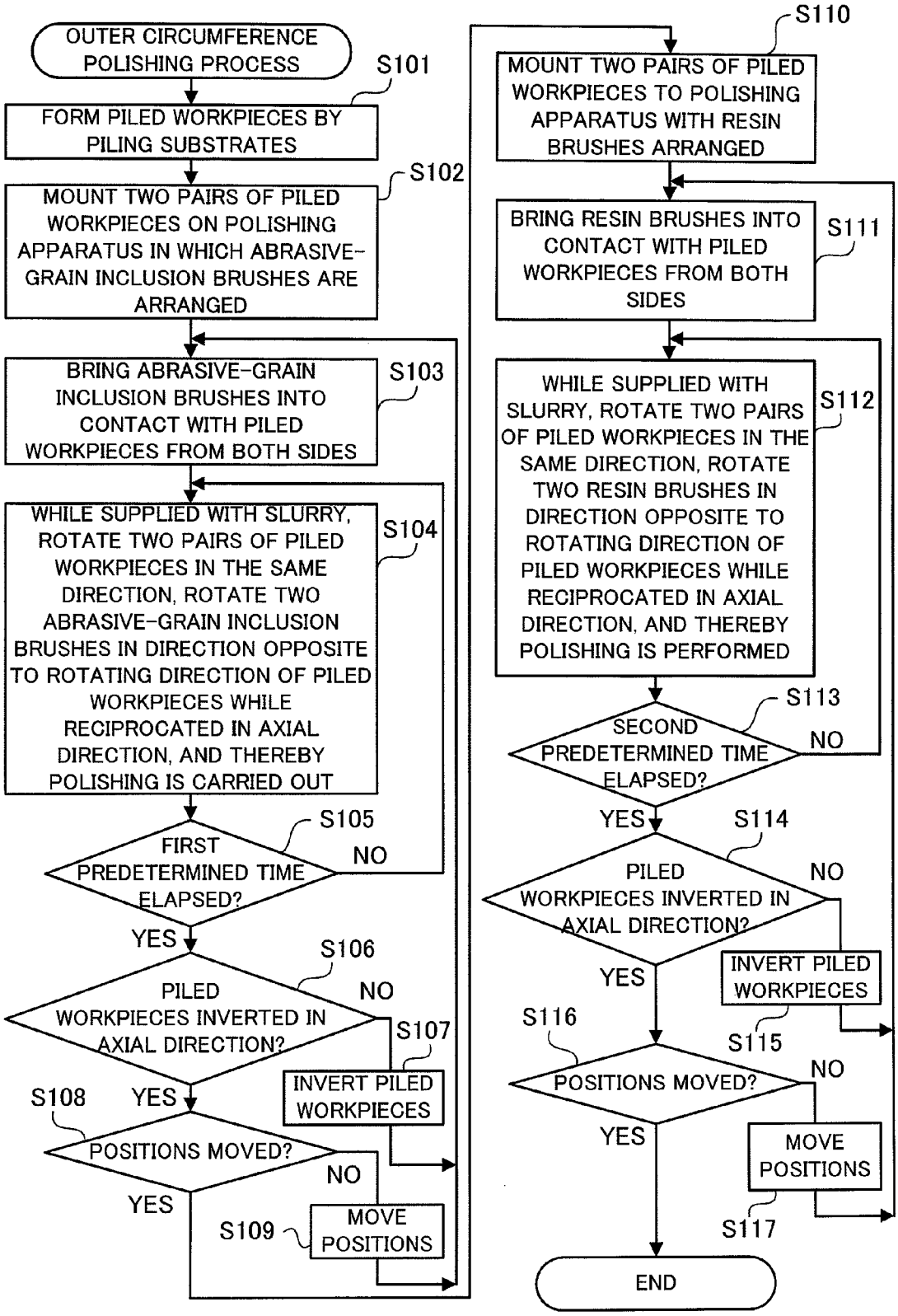
FIG. 6 is a flowchart illustrating the outer circumference polishing process shown in FIG. 1C in detail.

FIG. 6 is a flowchart illustrating the outer circumference polishing process shown in FIG. 1C in detail. The processing is mainly executed by a controller (not shown in the figure) provided in the polishing apparatus 100. In the outer circumference polishing process, first, the piled workpieces 200 are formed by piling the disk-shaped substrates 10 (step 101). In the present exemplary embodiment, the disk-shaped substrates 10 and the spacers 40 are alternately inserted and piled (See FIG. 5) so that the piled workpieces 200 in which approximately 150 pieces of disk-shaped substrates 10 as an example are piled are formed. The spacer 40 has the outer diameter smaller than that of the disk-shaped substrate 10.

After that, the shaft 210 is inserted into the piled workpieces 200. Then, in the polishing apparatus 100 in which the abrasive-grain inclusion brushes 50 shown in FIG. 3 are mounted, the plural (two pairs in the exemplary embodiment) piled workpieces 200 are mounted on the mounting portions 131 provided at two locations in the polishing work area 110 of the polishing apparatus 100 (step 102).

Next, two support shafts 132 shown in FIG. 2 are moved to the lower side in FIG. 2 so as to support the shafts 210 of the two pairs of the piled workpieces 200. Then, as shown in FIG. 3, the plural (two in FIG. 3) abrasive-grain inclusion brushes 50 are brought into contact with the piled workpieces 200 mounted to the polishing work area 110 from both sides (step 103). By this operation, as shown in FIG. 4, the piled workpieces 200 are set in the polishing apparatus 100 in a state where the plural pairs of the piled workpieces 200 and the plural abrasive-grain inclusion brushes 50 are in contact with each other.

After the piled workpieces 200 are set in the polishing apparatus 100 as mentioned above, the two pairs of the piled workpieces 200 are rotated in the same direction while being supplied with slurry, the two abrasive-grain inclusion brushes 50 are rotated in the direction opposite to the rotating direction of the piled workpieces 200 while being reciprocated in the axial direction (vertical direction in FIGS. 2 to 4), and thereby polishing is carried out (step 104). Here, the controller (not shown in the figure) determines whether or not a first predetermined time has elapsed (step 105). The first predetermined time is set in advance as a preferable time for the first polishing processing. If the first predetermined time has not elapsed, the processing in step 104 is repeated until it is elapsed.

When the first predetermined time is elapsed, different processing is performed according to whether or not the piled workpieces 200 has been inverted in the axial direction (vertical direction in the figure) at the same mounting portions 131 (step 106). If not inverted, the piled workpieces 200 is inverted in the axial direction according to, for example, a work instruction or the like displayed on a display (not shown in the figure) (step 107), the step returns to step 103 for processing. If the piled workpieces 200 have been inverted in the axial direction, different processing is performed according to whether or not the positions of the mounting portions 131 on which the two pairs of the piled workpieces 200 are mounted have been moved (step 108). If the positions have been moved, the step goes to the second polishing process at step 110 and thereafter. If the positions have not been moved, the positions are moved from one of mounting portions 131 to another according to, for example, a work instruction or the like displayed on the display (not shown in the figure) (step 109), and the step returns to step 103, and the processing is repeated. In this way, for the abrasive-grain inclusion brushes 50, polishing processing for a predetermined time is carried out four times. By the inversion in the axial direction, the rotating direction in contact of the abrasive-grain inclusion brushes 50 with respect to the disk-shaped substrates 10 piled in the piled workpieces 200 may be changed, and thereby the polished state may be made more uniform. In addition, by changing the positions of the piled workpieces 200 with respect to the mounting portions 131, variation in the polishing result caused by the contact positions with the abrasive-grain inclusion brushes 50 may be addressed, and thereby the polished state may be made more uniform. Since the state of contact with the rotating brushes is different according to the positions of the mounting portions 131 such that one is located in a direction toward which the rotating brushes (the abrasive-grain inclusion brushes 50) is approaching while the other is located in a direction from which the rotating brushes are leaving, the position changing has a great significance.

The second polishing process in step 110 and thereafter is executed for the disk-shaped substrates 10 in the piled workpieces 200 that have been polished in the first polishing process as mentioned above. In the second polishing process, the piled workpieces 200 are removed from the polishing apparatus 100 used in the first polishing process, and processing is carried out in the polishing apparatus 100 in which the resin brushes 60 shown in FIG. 3 is mounted. Here, on the two mounting portions 131 provided in the polishing work area 110 in the polishing apparatus 100 (See FIG. 3), the plural (two pairs in the exemplary embodiment) piled workpieces 200 having finished the first polishing process are mounted (step 110). Then, the two support shafts 132 shown in FIG. 2 are moved to the lower side in FIG. 2 so as to support the shafts 210 of the two pairs of the piled workpieces 200. Then, as shown in FIG. 3, the plural (two pieces in FIG. 3) resin brushes 60 are brought into contact with the piled workpieces 200 mounted in the polishing work area 110 from both sides (step 111) and the piled workpieces 200 waits to start the polishing in a state shown in FIG. 4.

After that, while being supplied with slurry, the two pairs of the piled workpieces 200 are rotated in the same direction, the two resin brushes 60 rotated in the direction opposite to the rotating direction of the piled workpieces 200 while being reciprocated in the axial direction (the vertical direction in FIGS. 2 to 4), and thereby polishing is performed (step 112). Here, the controller (not shown in the figure) determines whether or not a second predetermined time has elapsed (step 113). The second predetermined time is set in advance as a preferable time for the second polishing processing. If the second predetermined time has not elapsed, the processing in step 112 is repeated until the time is elapsed.

When the second predetermined time is elapsed, different processing is performed according to whether or not the piled workpieces 200 has been inverted in the axial direction (the vertical direction in the figure) at the same mounting portions 131 (step 114). If the piled workpieces 200 are not inverted, for example, the work instruction is displayed on the display (not shown in the figure), the piled workpieces 200 are inverted in the axial direction according to the display (step 115), and the step returns to step 111 for processing. If the piled workpieces 200 has been inverted in the axial direction, different processing is performed according to whether or not the positions of the mounting portions 131 on which the two pairs of the piled workpieces 200 are mounted have been moved (step 116). If the positions have not been moved, the positions are moved from one of the mounting portions 131 to another according to, for example, the work instruction or the like displayed on the display (not shown in the figure) (step 117), and the step returns to step 111 for processing. If the positions have been moved, the piled workpieces 200 are removed and the processing is finished.

In this way, the polishing processing for a predetermined time is executed for the resin brushes 60 four times. Similarly to the first polishing processing, by the inversion in the axial direction, the rotating direction of the resin brushes 60 with respect to the disk-shaped substrates 10 piled in the piled workpieces 200 may be changed. In addition, by changing the positions of the piled workpieces 200 with respect to the mounting portions 131, variation in the polishing result caused by the contact position with the resin brushes 60 may be addressed. By this operation, the polished state may be made more uniform.

As mentioned above, the outer circumference polishing process including the first polishing processing shown in step 101 to step 109 and the second polishing processing shown in step 110 to step 117 are executed.

Next, an example where the present exemplary embodiment is adopted is shown below.

—Disk Type: 1.89 Inches

The disk-shaped substrate 10

Diameter of the outer circumference 13 (outer diameter): 48 mm

Thickness: 0.55 mm

—The Spacer 40

Diameter: 46 mm

Thickness: 0.2 mm

—The Piled Workpieces 200

The piled number of the disk-shaped substrates: 150 pieces

The spacer 40: Interposed between each disk-shaped substrate

—The Abrasive-Grain Inclusion Brush 50

Outer diameter: 150 mm

Resin: Nylon (registered trademark) (For example, Nylon-6)

Wire diameter: 0.3 mm

Abrasive grains: Aluminum oxide (alumina)

Diameter of the abrasive grain: 30 μm

Grade of the abrasive grain: #600

Content rate: 20%

—The Resin Brush 60

Outer diameter: 150 mm

Material: Nylon-66

Wire diameter: 0.2 mm

—The Slurry

Specific gravity: 1.2

—Process Time

The first polishing process: 23 minutes (the first predetermined time) is repeated four (4) times The second polishing process: 12 minutes (the second predetermined time) is repeated four times By polishing in the above example, deep grinding damages caused by the outer circumference grinding stone 23 in the grinding process as a preprocessing, are smoothed and the disk-shaped substrates 10 in the piled workpieces 200 may be polished with a predetermined finishing accuracy.

The diameter of an abrasive grain of approximately 20 to 60 μm is preferable, and favorable results are obtained by using a grade of abrasive grain #320, #500 or #800. However, as the result of observation on a work time and work surface, #600 is the most favorable. In addition, diamond abrasive grain may be also adopted as an abrasive grain. Moreover, a resin of PBT (polybutylene terephthalate) and the like may be used as a resin for the abrasive-grain inclusion brush 50.

Next, a comparative example will be explained.

—Grade of Abrasive Grain: #1000, #1200

As the result of experiments by the inventors and the like, these are not favorable as an outer circumference polishing unit, because the abrasive grains are too fine (approximately 11 to 18 μm, for example) and work time is too long.

—Grade of Abrasive Grain: #240, #180, #100

As the result of experiments by the inventors and the like, the abrasive grain is too large (approximately 73 to 149 μm, for example) and linear damages are caused by these abrasive grains instead.

—Abrasive Grain: Silicon Carbide

Probably, it may result in the fact that silicon carbide is softer than aluminum oxide (alumina), a favorable polishing result is not obtained.

From the above example and comparative examples, polyamide resins such as nylon-6, nylon-610, nylon-612 and polyester resin such as PBT (polybutylene terephthalate) may be employed as a resin for the abrasive-grain inclusion brush 50 used in the first polishing process. For the type of abrasive grains, aluminum oxide and diamond are preferable, and aluminum oxide is preferable in view of economy. The grade of abrasive grain is preferably #320 to #800 and more preferably #600.

As described above in detail, according to the present exemplary embodiment, the outer circumferences 13 of the disk-shaped substrates 10 are polished using the abrasive-grain inclusion brushes 50 having fibers in which aluminum oxide (alumina) is included and the resin brushes 60 which is, for example, a simple nylon brush. By polishing using the abrasive-grain inclusion brushes 50 as a preprocessing prior to the polishing using the resin brushes 60, the surface having grinding damages which may not be polished only by slurry and the resin brushes 60 may be smoothed, and a favorable polishing result may be obtained without fine damages remained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A polishing method of a disk-shaped substrate for polishing an edge face of a disk-shaped substrate using polishing liquid, comprising in this sequence:

a first polishing process for polishing the edge face using a first brush made of a resin in which polishing abrasive grains are included; and a second polishing process for polishing the edge face using a second brush made of a resin in which the polishing abrasive grains are not included, wherein in the first polishing process and the second polishing process, the disk-shaped substrates are piled so that the outer circumferential edge faces of the piled disk-shaped substrates are opposed to the first or second brush, and a side wall portion and a chamfered portion provided on the outer circumferential edge face are polished at the same time, and in the first polishing process, the piled disk-shaped substrates are opposed to the first brush and polished, and the piled disk-shaped substrates are inverted, opposed to the first brush and polished.

2. The polishing method of a disk-shaped substrate according to claim 1, wherein the polishing abrasive grains are formed from aluminum oxide or diamond.

3. The polishing method of a disk-shaped substrate according to claim 1, wherein the resin as a material of the first brush is polyamide resin or polyester resin.

4. The polishing method of a disk-shaped substrate according to claim 1, wherein the disk-shaped substrates are piled with a spacer interposed between the disk-shaped substrates adjacent to each other, the spacer having an outer diameter smaller than a diameter of the disk-shaped substrate.

5. The polishing method of a disk-shaped substrate according to claim 1, wherein, in the first polishing process, a plurality of the first brushes are provided, a plurality of the piled disk-shaped substrates are set at different positions, each of the plurality of piled disk-shaped substrates is polished while being in contact with the plurality of first brushes, and then, each of the plurality of piled disk-shaped substrates is moved to one of the positions of the piled disk-shaped substrates and polished while being in contact with the plurality of first brushes.

6. The polishing method of a disk-shaped substrate according to claim 1, wherein, in the second polishing process, a plurality of the second brushes are provided, a plurality of the piled disk-shaped substrates are set at different positions, each of the plurality of piled disk-shaped substrates is polished while being in contact with the plurality of second brushes, and then, each of the plurality of piled disk-shaped substrates is moved to one of the positions of the piled disk-shaped substrates and polished while being in contact with the plurality of second brushes.

7. A polishing method of a disk-shaped substrate for polishing an edge face of a disk-shaped substrate using polishing liquid, comprising in this sequence:

a first polishing process for polishing the edge face using a first brush made of a resin in which polishing abrasive grains are included; and a second polishing process for polishing the edge face using a second brush made of a resin in which the polishing abrasive grains are not included, wherein in the first polishing process and the second polishing process, the disk-shaped substrates are piled so that the outer circumferential edge faces of the piled disk-shaped substrates are opposed to the first or second brush, and a side wall portion and a chamfered portion provided on the outer circumferential edge face are polished at the same time, and in the second polishing process, the piled disk-shaped substrates are opposed to the second brush and polished, and the piled disk-shaped substrates are inverted, opposed to the second brush and polished.

* * * * *